US006427363B1

(12) United States Patent
Hunter

(10) Patent No.: US 6,427,363 B1
(45) Date of Patent: Aug. 6, 2002

(54) REVERSIBLE SHOE

(76) Inventor: Leslie E. Hunter, P.O. Box 6031, Burton, SC (US) 29903

( * ) Notice: Subject to any disclaimer, the term of this patent is extended or adjusted under 35 U.S.C. 154(b) by 0 days.

(21) Appl. No.: 09/892,123

(22) Filed: Jun. 26, 2001

(51) Int. Cl.[7] ..... A43B 3/24; A43B 21/36; A43B 23/00; A43C 13/00

(52) U.S. Cl. ..... 36/100; 36/36; 36/15; 36/112; 36/9 R; 36/48

(58) Field of Search ..... 36/15, 100, 101, 36/77 R, 92, 69, 112, 36 R, 36 B, 9 R, 9 A, 11, 16, 45, 47, 48

(56) References Cited

U.S. PATENT DOCUMENTS

| | | | | | |
|---|---|---|---|---|---|
| 871,187 | A | * | 11/1907 | Saunders | 36/11 |
| 1,438,072 | A | * | 12/1922 | Wagner | 36/11 |
| 2,261,125 | A | * | 11/1941 | McFeely | 36/100 |
| 2,409,813 | A | * | 10/1946 | Timson | 36/100 |
| 2,630,636 | A | * | 3/1953 | Cockrell | 36/11 |
| 2,742,715 | A | * | 4/1956 | Meltzer | 36/100 |
| 2,974,427 | A | * | 3/1961 | Wolff | 36/11 |
| 3,057,085 | A | * | 10/1962 | Rigsby | 36/11 |
| 3,141,247 | A | | 7/1964 | Mackay | |
| 3,373,510 | A | | 3/1968 | Memole et al. | |
| 4,246,707 | A | * | 1/1981 | Pedersen | 36/100 |
| D293,159 | S | | 12/1987 | Sacre | |
| 4,748,752 | A | | 6/1988 | Tanel | |
| 4,850,122 | A | | 7/1989 | Schwab, Jr. | |
| D303,451 | S | | 9/1989 | Weiner | |
| 4,887,369 | A | * | 12/1989 | Bailey et al. | 36/101 |
| D306,513 | S | | 3/1990 | Sachs et al. | |
| D315,440 | S | | 3/1991 | Hegy | |
| 5,029,405 | A | | 7/1991 | DeHaitre | |
| 5,172,493 | A | | 12/1992 | Diaz | |
| 5,251,386 | A | | 10/1993 | Diaz | |
| 5,272,822 | A | | 12/1993 | Diaz | |
| 5,311,676 | A | | 5/1994 | Hughes et al. | |
| 5,381,610 | A | * | 1/1995 | Hanson | 36/100 |
| 5,822,888 | A | * | 10/1998 | Terry | 36/100 |
| D413,427 | S | | 9/1999 | Fellouhe | |
| 6,035,554 | A | * | 3/2000 | Duncan | 36/100 |

* cited by examiner

*Primary Examiner*—Anthony D. Stashick
(74) *Attorney, Agent, or Firm*—Harleston Law Firm; Kathleen M. Harleston

(57) ABSTRACT

A reversible shoe that can be taken apart and reassembled with inside and outside faces reversed includes: (a) a reversible sole; (b) two side flaps, each affixed to the sole along a longitudinal side edge of the sole; (c) a heel flap attached at one end to a posterior end of the sole; and (d) attachment means, such as zippers, laces, snaps, and buttons, for attaching one portion of the shoe to another. The reversible shoe has a generally flat, unassembled position for storage, and two opposite assembled positions ready for wear as a shoe. This reversible shoe allows the user to switch from one style to another, one color to another, monotone to multi-hued, or from plain to decorated. A method for assembling a reversible shoe, and a kit for building a reversible, readily assembled shoe are also included.

15 Claims, 8 Drawing Sheets

REVERSIBLE SHOE

BACKGROUND OF THE INVENTION

1. Technical Field

The present device is a reversible shoe that allows the wearer to change the color of the shoe by disassembling it and reversing the inside and outside of the shoe, and then reassembling it.

2. Background Information

Many women and a growing number of men in the United States are enthusiastic shoe collectors. As fashions change, they continually add to their shoe collection and discard barely worn shoes from the previous season. For women especially, shoe styles change each season, and staying in style is a costly endeavor for them.

The reversible shoe of the present invention fulfills a need for an inexpensive, versatile, stylish shoe which can be quickly and easily converted from one side to the other. The reversible shoe cuts down on the number of separate pairs of shoes that must be purchased for different occasions, for example, casual shoes for wearing to work and dressier shoes for a evening out. In addition to cost savings, being able to maintain fewer shoes helps to free up closet space, reduce shopping time, lower the number of trips to shoe repair shops, and facilitate packing for trips. With the present invention, gentlemen and ladies need not carry an extra pair of shoes for going out to dinner after work. Instead, they can carry the reversible shoe of the present invention, to decorate and add color to their shoes. This reversible shoe allows the user to switch from one style to another, one color to another, monotone to multi-hued, or from plain to decorated. The reversible shoe can be designed to suit certain occasions, such as Thanksgiving and Christmas. Shoes according to the present invention, then, are more versatile than conventional shoes because they can be worn to match several outfits.

Also, some people wear their shoes out from the inside out, particularly in the toe area of the shoe. Many commercially available shoes are shelved or discarded because the toe area wears out or is in poor condition. With the present invention, their shoes will last longer because they worn on both sides.

BRIEF SUMMARY OF THE INVENTION

The present invention is a reversible shoe that can be taken apart and reassembled with inside and outside faces reversed, the shoe comprising:

(a) a generally flat, reversible sole;

(b) two side flaps, each affixed to the sole along a longitudinal side edge of the side flap, and a longitudinal side edge of the sole;

(c) a heel flap attached at one end to a posterior end of the sole; and (d) attachment means for attaching one portion of the shoe to another;

wherein the attachment means are attached to the shoe along two opposite side edges of the heel flap on both faces, with complementary attachment means along a posterior end of each side flap on both faces; along both faces of a free edge of each side flap, with complementary attachment means on opposite anterior portions of the side flaps on both faces; and wherein the reversible shoe has a flat, unassembled position for storage, and two opposite assembled positions ready for wear as a shoe. Also included herein are a method for assembling a reversible shoe, and a kit for building a reversible, readily assembled shoe.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
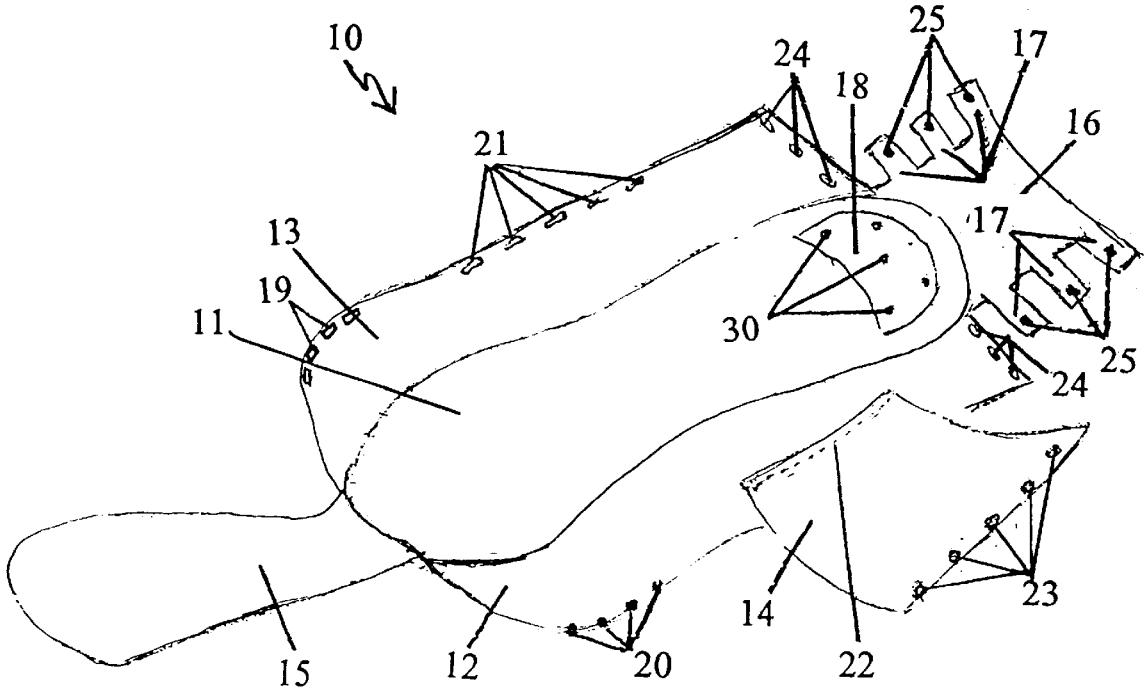
FIG. 1 is a perspective view of a reversible shoe according to the present invention, shown in an unassembled button and snap embodiment.
Figure 2:
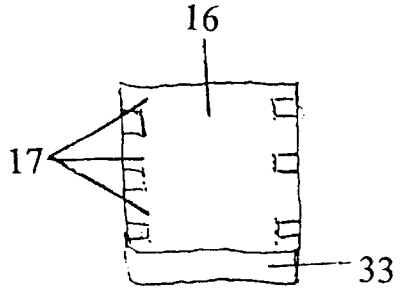
FIG. 2 is a rear elevational view of a reversible shoe according to the present invention, shown in an assembled button and snap embodiment.

In the following description, like reference characters designate like or corresponding parts throughout the several views. Also, in the following description, it is to be understood that such terms as "front," "back," "inside," and the like are words of convenience and are not to be construed as limiting terms. Referring in more detail to the drawings, the invention will now be described.

Referring to FIG. 1, a reversible shoe of the present invention, generally referred to as 10, is shown in a first embodiment, a button and snap embodiment. The reversible shoe 10 includes: (a) a sole 11 in approximately the shape of a sole of an ordinary shoe or foot, the sole having a front toe portion and a rear heel portion; (b) two side flaps 12, 13 each joining the sole 11 along a longitudinal edge of the sole, corresponding to the sides of the wearer's foot; (c) a front flap constituting the tongue 15 of the shoe 10, the tongue 15 having a narrow end portion attached to the toe portion of the sole; (d) a heel flap 16 attached at one end to the heel portion of the sole 11; and (e) attachment means for attaching one portion of the shoe 10 to another. The heel flap 16 is joined to the sole 11 along the narrow, curved rear edge of the heel portion, corresponding to the back of a wearer's foot.

The button and snap embodiment of FIG. 1 is preferably made from a single piece of flexible material, such as leather or a sturdy, durable fabric. The side flaps 12, 13, tongue 15, and heel flap 16 may be made from the same piece of material as the sole 11, or may be separate pieces attached by stitching or other means to the sole 11. A generally rectangular flap 14 is attached to one side 12 by stitching 22.

Referring to FIGS. 1, 2, 4, and 6, to assemble the button and snap shoe 10 for wearing, the tongue 15 is folded back over the sole 11, as in an ordinary shoe. The side flaps 12, 13 are pulled toward the center of the sole 11 and the rectangular flap 14 is attached to the opposite side 13 by buttons 23 attached through conventional buttonholes 21. The side flaps 12, 13 are curved from front to back, so that the front of each is narrower than the back. Snap members 20 at the edge of one side flap 12 are snapped onto complementary snap members 19 on the edge of the opposite side flap 13 of the shoe. Thus, when the shoe 10 is assembled, the side flaps 12, 13 are joined together at their anterior (toe) portions by snaps, closing the front portion of the shoe 10, while the middle portion of the shoe 10 remains partly open. The two sides 12, 13 are joined by, and the top arch of the foot is covered by, the rectangular flap 14. The tongue 15 also covers the top of the foot. The rear of the shoe 10 is held together by buttoning the heel flap 16 to the side flaps 12, 13, by means of a row of buttons 25 sewn in to a row of tabs 17 on the fabric and buttoned to a row of corresponding button holes 24 on the back edge of each side 12, 13. The side flaps, heel flap, and rectangular flap can be attached in any order.

Figure 3:
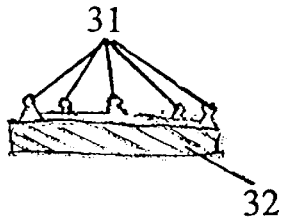
FIG. 3 is a rear elevational view of a shoe heel according to the present invention.
Figure 5:
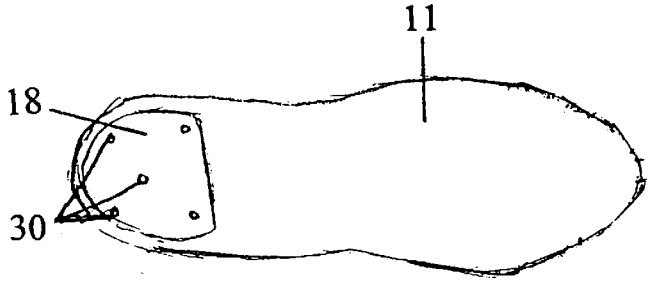
FIG. 5 is a bottom plan view of the shoe according to FIG. 4.

Referring to FIGS. 1, 3, and 5, the sole 11 also includes a heel plate 18 with female snap members 30 whereby a detachable heel 32 may be attached to the sole 11. The detachable heel 32 contains a set of male (or female) snap members 31 corresponding to the female (or male) snap members 30 in the heel plate 18. The detachable heel 32 may thus be easily attached to or removed from the sole 11 of the shoe 10 as desired by the wearer.

Figure 4:
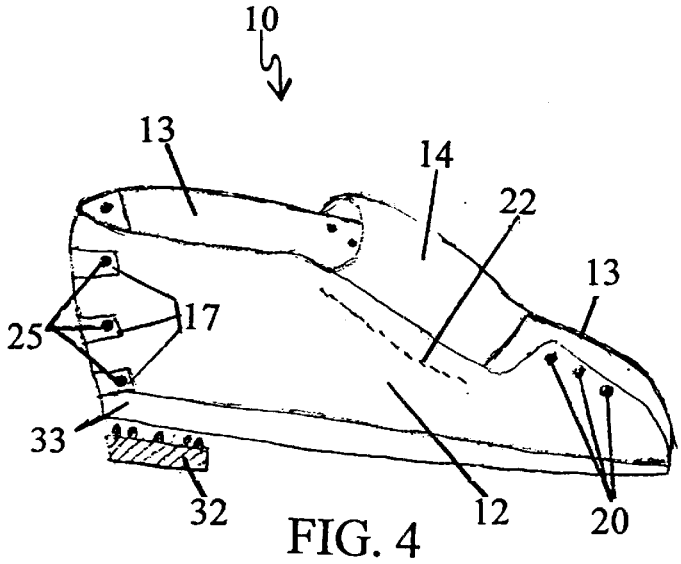
FIG. 4 is a right perspective view of a reversible shoe according to the present invention, shown in the assembled button and snap embodiment.
Figure 6:
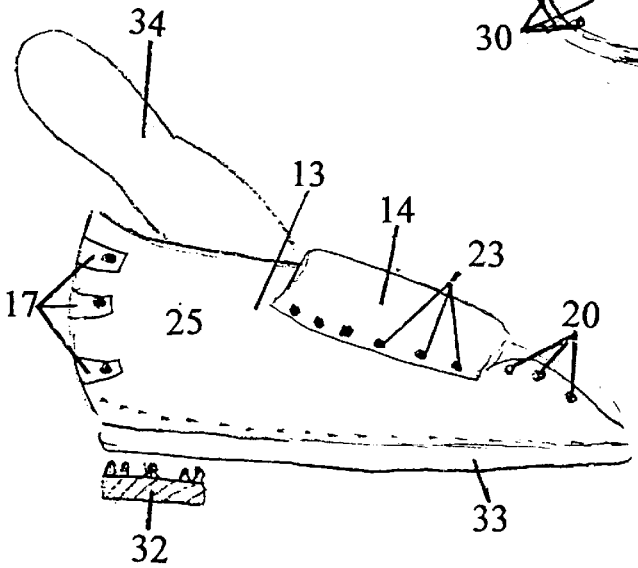
FIG. 6 is a right perspective view of a reversible shoe according to the present invention, shown reversed, with insert, in the button and snap embodiment.
Figure 7:
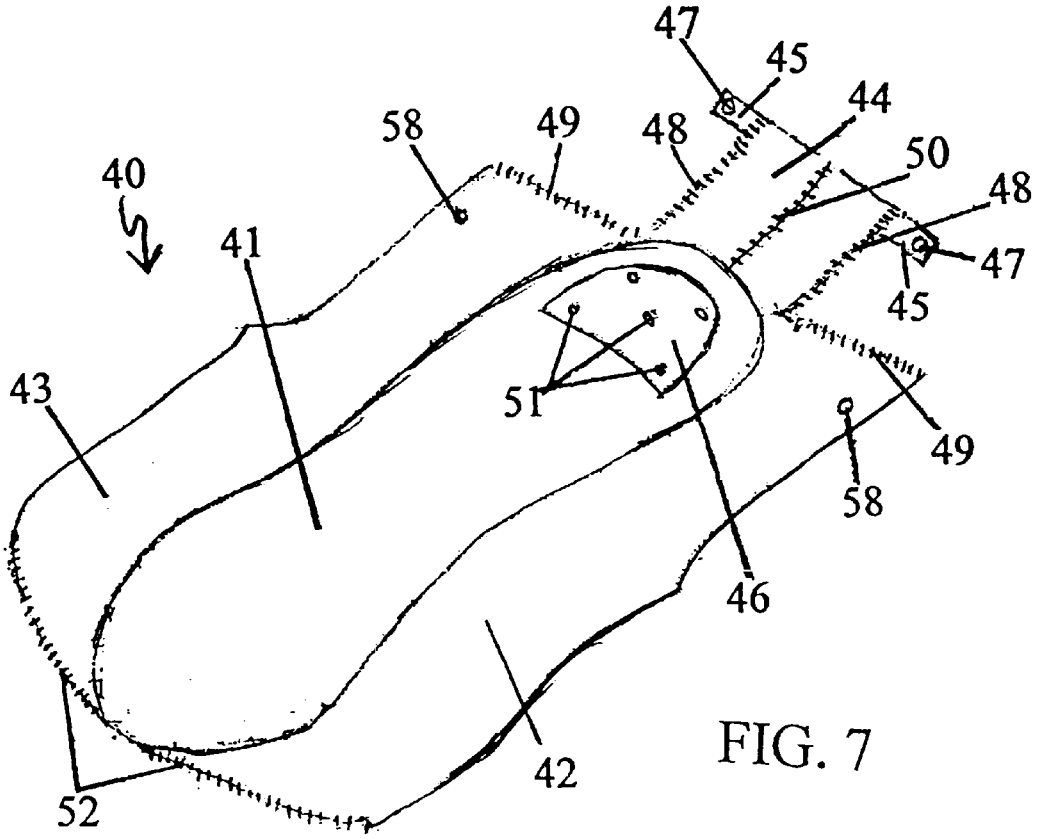
FIG. 7 is a perspective view of a reversible shoe according to the present invention, shown in an unassembled zipper embodiment.
Figure 8:
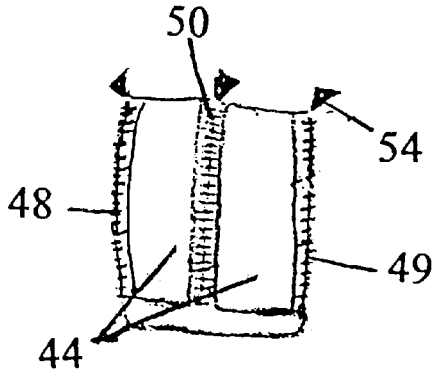
FIG. 8 is a rear elevational view of a reversible shoe according to the present invention, shown in an assembled zipper embodiment.
Figure 9:
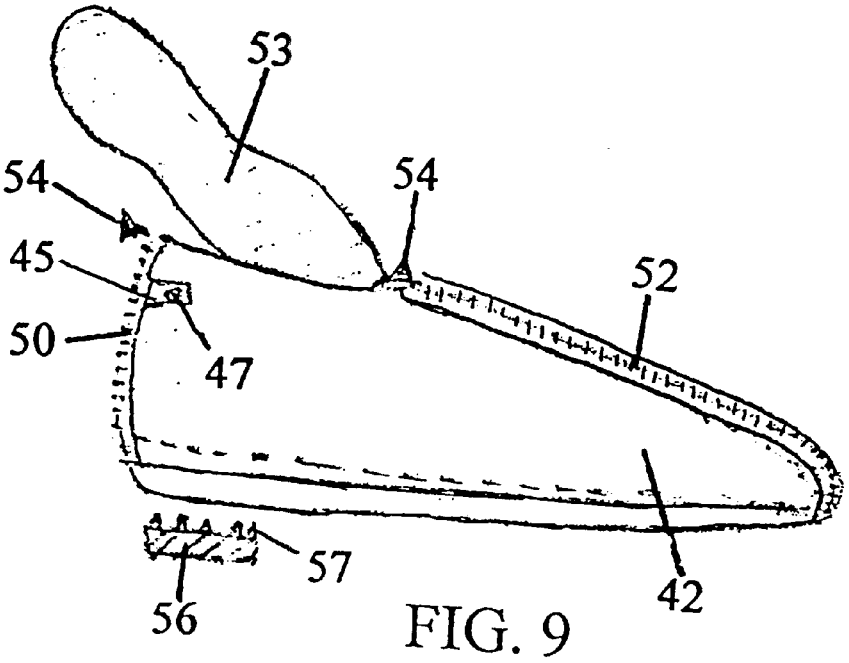
FIG. 9 is a right perspective view of a reversible shoe according to the present invention, shown in an assembled zipper embodiment with insert.
Figure 10:
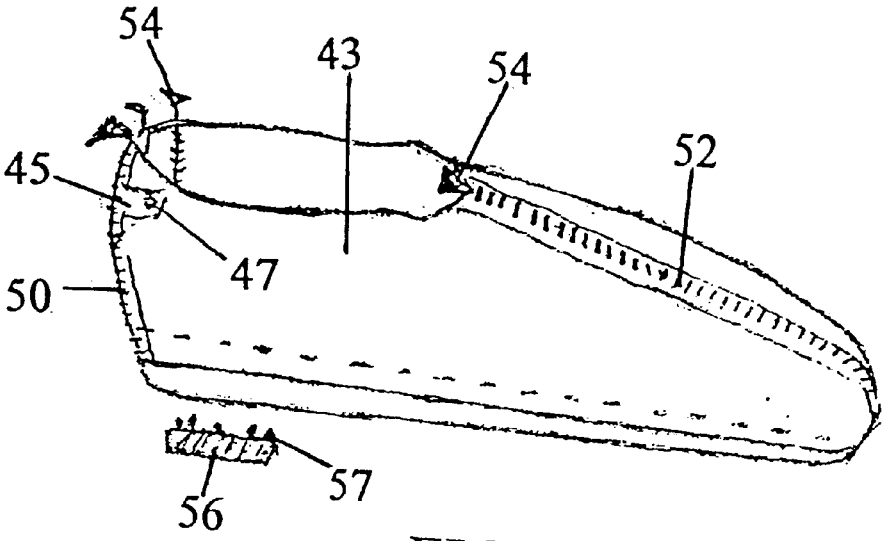
FIG. 10 is a right perspective view of a reversible shoe according to the present invention, shown reversed, in an assembled zipper embodiment.
Figure 11:
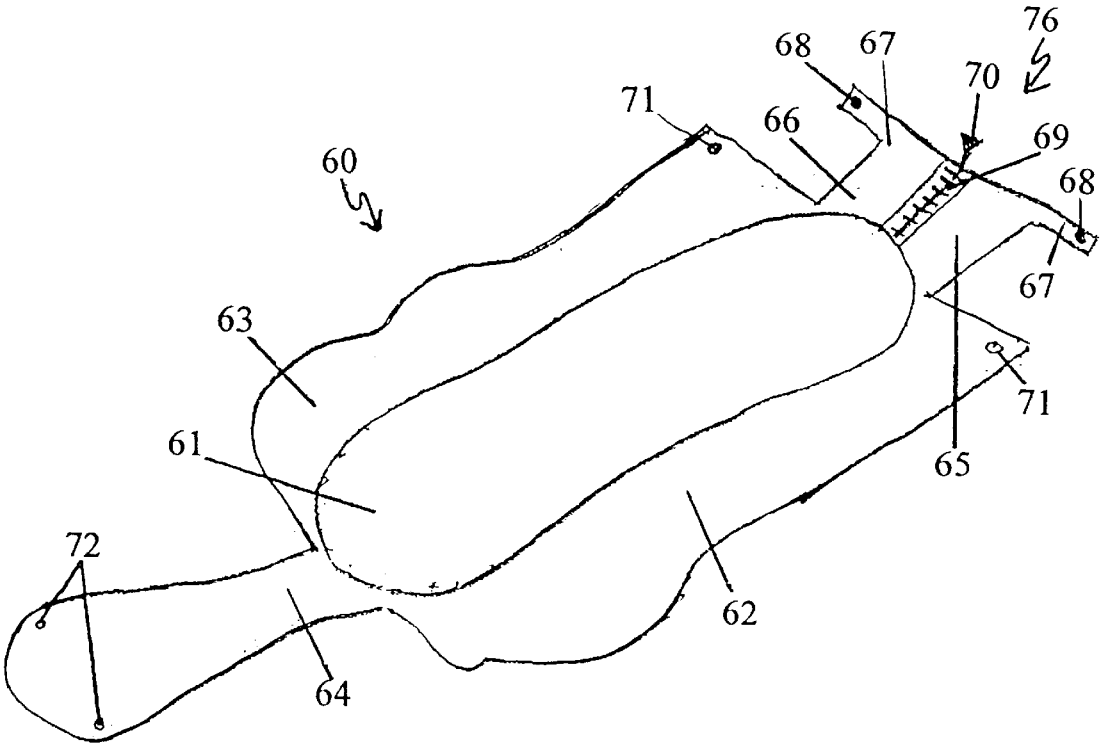
FIG. 11 is a perspective view of a reversible shoe according to the present invention, shown in an unassembled zipper and button embodiment.
Figure 12:
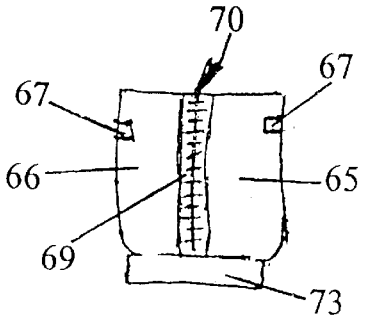
FIG. 12 is a rear elevational view of a reversible shoe according to the present invention, shown in an assembled zipper and button embodiment.

Comparing FIG. 4 and FIG. 6, the shoe 10 may be reversibly assembled, so that the side of the shoe 10 shown in FIG. 1 becomes the outside when assembled as in FIG. 4, or the inside when assembled as in FIG. 6. Thus, the right side 12 in one assembly, shown in FIG. 4, becomes the left side 12 in the reverse assembly, shown in FIG. 6, and the left side 13 in the first assembly, shown in FIG. 4, becomes the right side 13 in the reverse assembly, shown in FIG. 6. The entire shoe 10 may be of different colors on opposite sides, so that when the shoe 10 is assembled in reverse, a different color will show on the outside. To facilitate reverse assembly, buttons 23 on the rectangular flap 14 and buttons 25 on the heel flap 16 are placed on both sides of the flap, so that assembly is the same when reversed. The edge 33 of the sole can be seen from the outside in FIG. 4. The sole 11 may be thick or thin.

With continued attention to FIG. 6, a sole insert 34 may also be placed inside the shoe 10, so that, when the shoe assembly 10 is reversed, the wearer's foot need not directly contact the surface that previously was on the outside and directly in contact with the ground. For the purpose of illustration, the insert is shown protruding from the top of the shoe in FIG. 6. In use, the sole insert 34 is placed down inside the shoe 10 over the sole 11.

In general, the wearer can disassemble and then reassemble this shoe 10, with the inside and outside reversed. The shoe is made of at least one, and preferably only one, piece of leather, cloth, or other durable fabric. It can be made of one piece of one type of material and have an overlay of another type of material, such as leather and fabric. It can be easily assembled into a shoe by means of laces, zippers, button, and snaps, or combinations thereof. The shoe preferably includes a detachable heel. The detachable heel is preferably attached on one side and not the other. The heel can alternatively be worn on either side, i.e., it can be removed and reattached from the other side when the shoe is reversed. The heel can be worn or omitted according to the wearer's preference. The shoe can also include a sole insert that is generally intended to be worn in all preferred embodiments of the shoe, although the shoe can be worn without the sole insert. The sole insert protects the shoe from dirt and wear, and it can be discarded and replaced when/if it becomes soiled. Once removed, the shoe can be put back on the foot with the inside and outside reversed, thus allowing the wearer to choose between two different colors or decorative styles in the same pair of shoes.

Turning to FIGS. 7, 8, 9, and 10, an alternative embodiment of the invention utilizes zippers 48, 49, 50, 52 to assemble the shoe 40. In this embodiment, the tongue 15 from the button and snap embodiment 10 in FIG. 1 may be omitted. The two sides 42, 43 are joined together by means of zippers 52 placed along the front edges. When assembled, the front zipper 52 runs along the center of the shoe 40 towards the back, stopping approximately two-thirds of the way from the front to the back, leaving the two sides 42, 43 unconnected to each other in the rear portion along the top edges, allowing a space for the wearer's ankle, as in an ordinary shoe. The back edge of each side 42, 43 is attached to the edge of the heel flap 44 similarly to the button and snap embodiment in FIG. 1, by means of back side zippers 48, 49 instead of buttons 25. A single tab 45 at the top of each side of the heel flap 44 may be included with a button or male snap 47 which may be attached to a corresponding button hole or female snap 58 placed toward the rear of each side 42, 43. As in the button and snap embodiment in FIG. 4 and FIG. 6, the shoe 40 may be reversed, so that the outside becomes the inside, and vice-versa, thus allowing the wearer to change the color of the shoe 40. A sole insert 53 may also be used, as in the previous embodiment, FIG. 6. When the shoe assembly is reversed, the sole insert prevents the wearer's foot from contacting the surface of the shoe that previously was on the outside and directly in contact with the ground.

Figure 13:
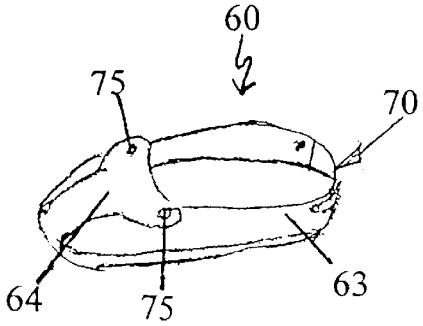
FIG. 13 is a left perspective view of a reversible shoe according to the present invention, shown in an assembled zipper and button embodiment.
Figure 14:
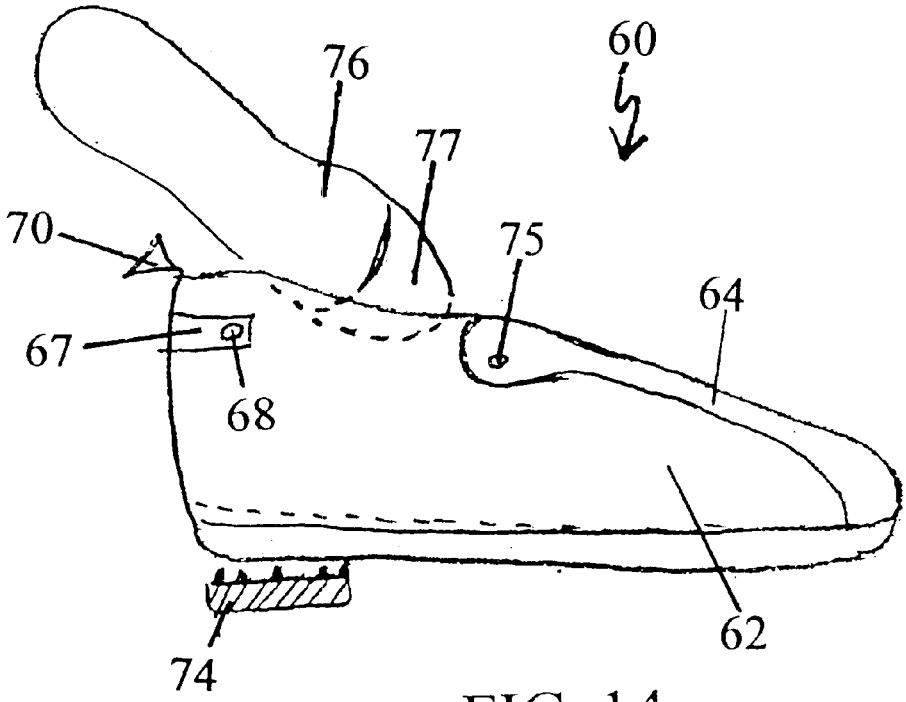
FIG. 14 is a right elevational view of a reversible shoe according to the present invention, shown in an assembled zipper and button embodiment with insert.
Figure 15:
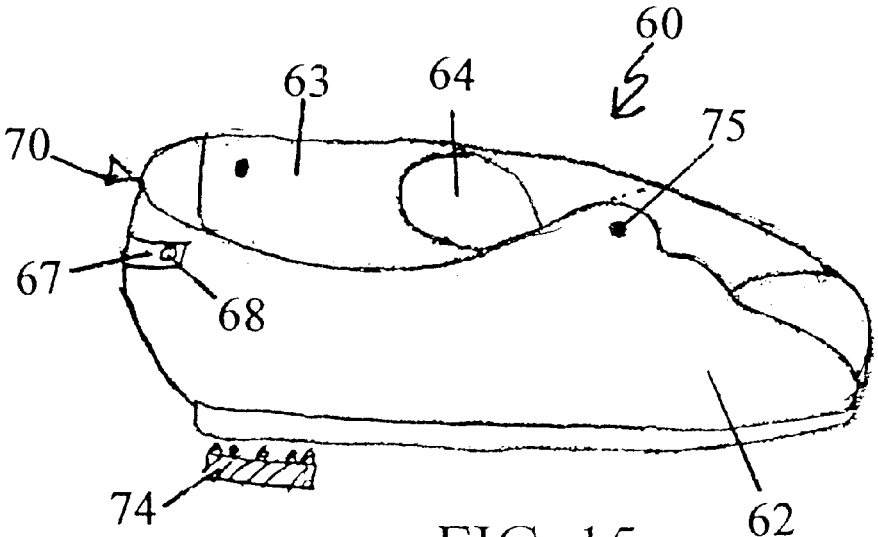
FIG. 15 is a right perspective view of a reversible shoe according to the present invention, shown in a reversed, zipper and button embodiment.

Referring to FIGS. 11 through 15, another embodiment of the shoe 60 may be assembled by means of a combination of zippers 69 and buttons 68, 75. In this zipper and button embodiment 60, the heel flap 76 may be comprised of two pieces 65, 66 joined by a center zipper 69 to form a symmetrical flap having two tabs 67 at the top, as in the zipper configuration shown in FIG. 7, each of which attaches by means of a button 68 or male snap member to a corresponding buttonhole 71 or female snap member on the trailing edge of each side flap 62, 63. When the shoe 60 is assembled, the side flaps 62, 63 are folded toward the center and joined to the heel flap 76 as described above, while the tongue 64 is folded back and may remain on the outside of the shoe 60, being joined to each side flap 62, 63 by a button 75 and buttonhole 72, as shown in FIG. 13 and FIG. 14, or may be placed inside the shoe 60, as shown in FIG. 15. As in the previous embodiments, the shoe 60 may be disassembled and reassembled in reverse, and a sole insert 76 and detachable heel 74 may be used. The sole insert 76 optionally comprises a soft cloth overlay 77 on the toe portion for comfort.

Figure 16:
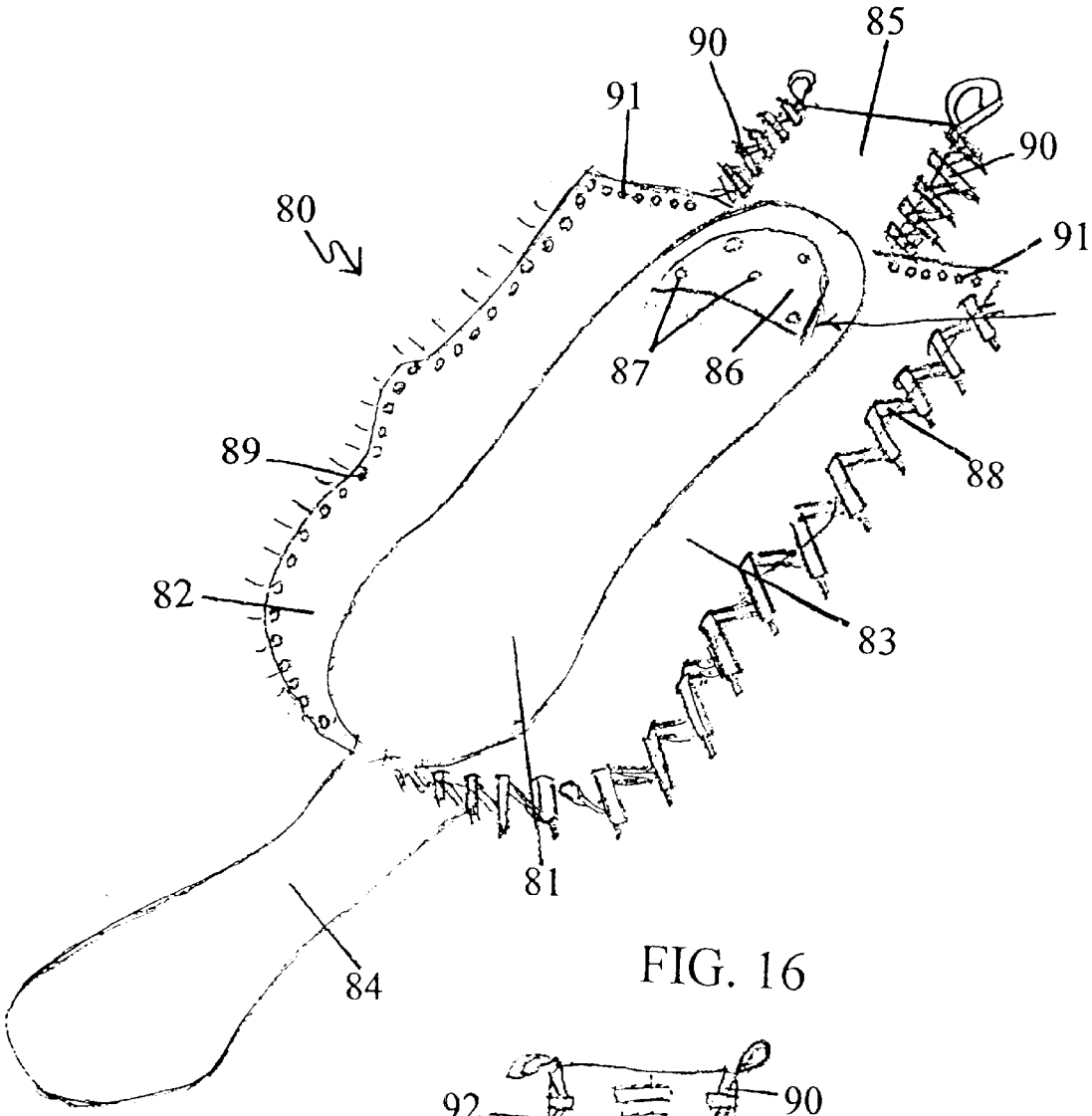
FIG. 16 is a perspective view of a reversible shoe according to the present invention, shown in an unassembled lace-up embodiment.
Figure 17:
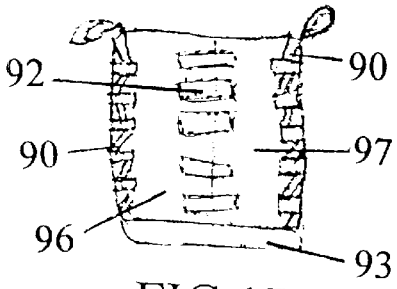
FIG. 17 is a rear elevational view of a reversible shoe according to the present invention, shown in an assembled lace-up embodiment.
Figure 18:
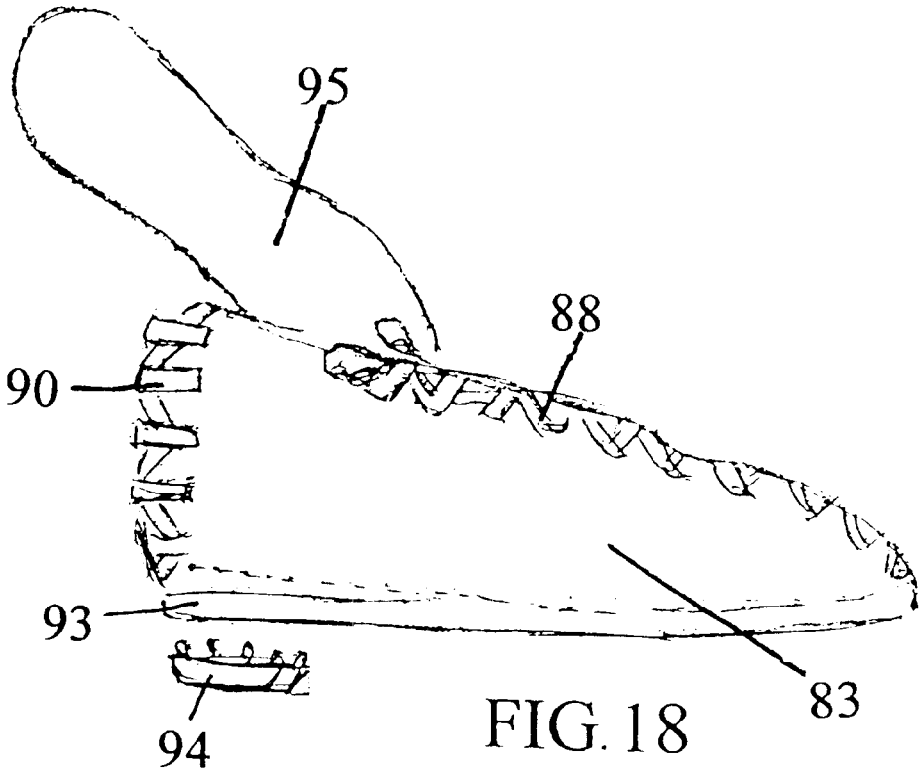
FIG. 18 is a right elevational view of a reversible shoe according to the present invention, shown in an assembled lace-up embodiment with insert.
Figure 19:
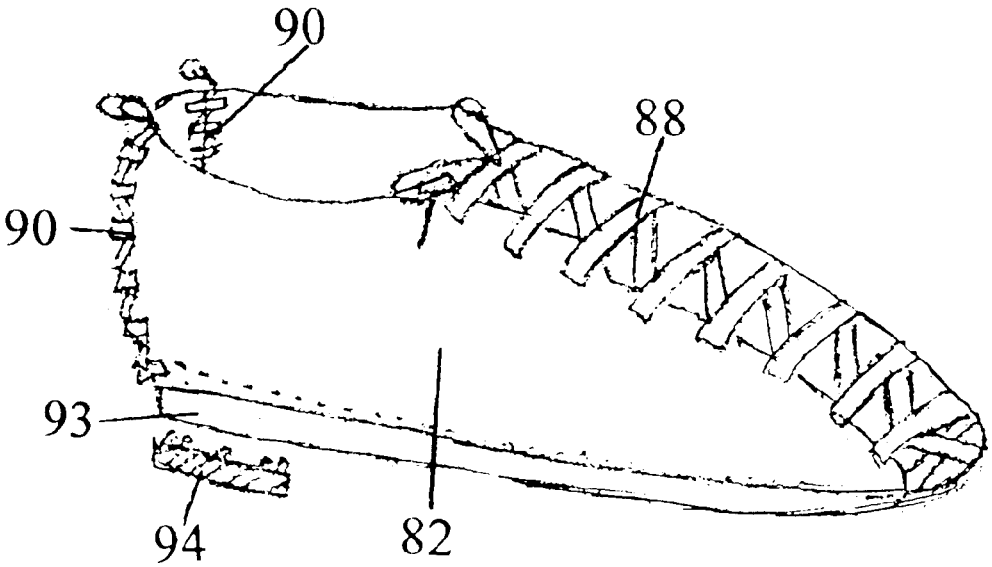
FIG. 19 is a right perspective view of a reversible shoe according to the present invention, shown in a reversed lace-up embodiment.

Turning to FIGS. 16 through 19, in another embodiment the shoe 80 may be constructed with a lace-up configuration. As shown in FIG. 16, this embodiment of the shoe 80 includes the sole 81, and the heel plate 86 with female snap members 87. In this embodiment, the entire edge of each side 82, 83 is perforated with a row of lace eyelets 89, and the two side flaps 82, 83 are pulled together and joined by laces 88, such as shoelaces. The tongue 84 is pulled back, as in the previous embodiments, and placed inside the shoe 80, that is, beneath the side flaps. The side flaps 82, 83 are joined to the heel flap 85, also by laces 90 through a row of eyelets 91 along the trailing edge of the sides 82, 83. The heel flap 85 may be in two pieces 96, 97, as shown in FIG. 17, joined by a center lace 92 to form a rectangular flap 85, or may be constructed of one piece with no center laces. In other respects, the lace-up configuration is similar to the other embodiments. A sole insert 95 and detachable heel 94 may be used, and the entire shoe 80 may be reversibly assembled.

In summary, a preferred embodiment of the shoe includes:

(1) a tongue 15 having a narrow end portion attached to the anterior toe portion of the sole and an opposite free end;

(2) a rectangular flap 14 affixed along one of its edges to one of the side flaps of the shoe, the rectangular flap comprising attachment means along an opposite edge;

(3) laces or zippers as the attachment means;

(4) a detachable heel 32;

(5) a heel plate 18 attached to the sole 11, the heel plate having snap members 30 on its face, the snap members 30 being attachable to corresponding snap members 31 on an upper face of the detachable heel 32; and (6) a zipper 69 up the center of the heel flap, joining one longitudinal half of the heel flap to the other 65, 66.

In a preferred embodiment:

(a) the reversible shoe 10 is made of a single piece of material, or a two-ply layer of material (e.g., canvas on one face and leather on an opposite face);

(b) the side flaps 12, 13 are generally rectangular in shape, and curved at their anterior ends, with a straight edge at each posterior end, the anterior portions of each side flap being narrower than their posterior portions;

(c) the heel flap 16 comprises from one to about five tabs 17 projecting from each side edge of the heel flap, with the same number of tabs 17 on each side edge, a means of attachment 25 being affixed to both faces of each tab 17, with a corresponding means of attachment 24 affixed to a posterior edge on both faces of each side flap, with the same number of attachment members 24 on each side flap; and (d) the attachment means are buttons 68 and buttonholes 71, 72, or snaps 20.

Also included in the present invention is a method for assembling a reversible shoe 10 on a wearer's foot, the shoe 10 including a sole 11, a tongue 15 attached to an anterior end of the sole 11, two side flaps 12, 13 attached to the longitudinal edges of the sole, a rectangular flap 14 attached to a side flap 12, and attachment means attached to the shoe 10. The method includes the steps of:

(a) pulling the heel flap 16 up to a generally vertical position;

(b) attaching attachment means 25 on the heel flap 16 to complementary attachment means 24 at the posterior ends of each of the side flaps 12, 13;

(c) folding the tongue 15 back over the top of the wearer's foot in the shoe 10;

(d) pulling the side flaps 13 up over the wearer's foot;

(e) attaching the side flaps 12, 13 to one another at an anterior toe portion of the side flaps using complementary attachment means 20 on each side flap 12, 13.

The method preferably further includes the steps of:

(d1) pulling a free edge of the rectangular flap 14 over a top arch of the wearer's foot over to the opposite side flap 13;

(d2) attaching attachment means 23 on the free edge of the rectangular flap 14 to complementary attachment means 21 on the opposite side flap 13. The method preferably further includes the step of attaching a detachable heel 32 to the bottom of the shoe 10 at the heel. The steps related to attaching the rectangular flap 14, may follow or precede the step related to attaching the side flaps 12, 13 to one another, (e). The steps related to attaching the heel flap 16 may follow or preceded the step related to attaching the side flaps 12, 13 to one another, (e). Preferably, the attachment means are buttons, zippers, snaps, or a mixture thereof. In one embodiment, the attachment means comprise laces 88, 90, 92, and step (e) comprises removably fastening the side flaps to one another and the heel flap to the posterior edges of the side flaps by lacing at least one lace through eyelets 89, 91 along the edges of the side flaps and heel flap. The method preferably further includes the step of attaching a detachable heel 32 to the bottom of the shoe at the heel. The attachment means preferably include zippers.

Also included herein is a portable kit for building a reversible, readily assembled shoe. The kit includes:

(a) a flat, unassembled shoe 10, comprising a sole 11, a tongue 15 attached to an anterior end of the sole 11, two side flaps 12, 13 attached to the longitudinal edges of the sole, a rectangular flap 14 attached to a side flap 12, and attachment means attached to the shoe 10 for detachably attaching one portion of the shoe to another; and (b) a detachable heel 32.

The reversible shoe 10 with detachable heel 32 is as described herein. The unassembled shoe 10 is easy to carry, in a purse or pocket, for example, or store when it is folded or rolled up. It can optionally comprise a lace or band at one end for encompassing the rolled up shoe, so that it resembles a sleeping bag.

From the foregoing it can be realized that the described device of the present invention may be easily and conveniently utilized as a means for making a shoe that is reversible from inside to outside, allowing an interchange of colors or of other decorative or stylistic features of the shoe. The wearer thus has the advantages of two pairs of shoes in one. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 reversible shoe in button and snap embodiment
11 sole
12 right side flap
13 left side flap
14 rectangular flap
15 tongue
16 heel flap
17 tabs on heel flap
18 heel plate
19 snap members
20 opposite snap members
21 buttonholes
22 stitching
23 side buttons
24 back buttonholes
25 back buttons
30 heel snap members (female)
31 heel snap members (male)
32 detachable heel
33 edge of sole
34 sole insert
40 Embodiment 2: zipper, unassembled
41 sole
42 right side flap
43 left side flap
44 heel flap
45 back tabs
46 heel plate
47 snaps
48 left back side zipper
49 right back side zipper
50 back center zipper
51 heel snap members (female)
52 front center zipper
53 sole insert
54 zipper fly
56 detachable heel
57 heel snaps
58 snaps
60 Embodiment 3: zipper and button, unassembled
61 sole
62 right side flap
63 left side flap
64 tongue
65 heel flap, right side
66 heel flap, left side
67 back tabs
68 button
69 center zipper
70 zipper fly
71 side flap buttonholes
72 tongue buttonholes
73 edge of sole
74 detachable heel
75 button
76 heel flap
77 cloth overlay on sole insert
80 Embodiment 4: lace-up, unassembled
81 sole
82 right side flap
83 left side flap
84 tongue
85 heel flap
86 heel plate
87 heel snap members (female)
88 center laces
89 center lace eyelets
90 back laces
91 back lace eyelets
92 back center laces
93 edge of sole
94 detachable heel
95 sole insert
96 heel flap, left side
97 heel flap, right side

What is claimed is:

1. A reversible shoe that can be taken apart and reassembled with inside and outside faces reversed, the shoe comprising:

(a) a generally flat, reversible sole;

(b) two side flaps, each affixed to the sole along a longitudinal side edge of the side flap, and a longitudinal side edge of the sole;

(c) a heel flap attached at one end to a posterior end of the sole;

(d) attachment means for attaching one portion of the shoe to another;

(e) a tongue flap comprising a narrow end portion attached to the toe portion of the sole and an opposite free end; and (f) a rectangular flap affixed along one of its edges to one of the side flaps of the shoe, the rectangular flap comprising attachment means along an opposite edge;

wherein the attachment means are attached to the shoe along two opposite side edges of the heel flap on both faces, with complementary attachment means along a posterior end of each side flap on both faces; along both faces of a free edge of each side flap, with complementary attachment means on opposite anterior portions of the side flaps on both faces; and wherein the reversible shoe has a generally flat, unassembled position for storage, and two opposite assembled positions ready for wear as a shoe.

2. A reversible shoe according to claim 1, wherein the attachment means comprise laces.

3. A reversible shoe according to claim 1, wherein the reversible shoe is made of a single piece of material, or a single piece of two-ply material.

4. A reversible shoe according to claim 1, wherein the attachment means comprise zippers.

5. A reversible shoe according to claim 1, further comprising a detachable heel.

6. A reversible shoe according to claim 1, wherein the side flaps are generally rectangular in shape, and curved at their anterior ends, with a straight edge at each posterior end, the anterior portions of each side flap being narrower than their posterior portions.

7. A reversible shoe according to claim 6, further comprising a zipper up the center of the heel flap, joining one longitudinal half of the heel flap to the other.

8. A reversible shoe that can be taken apart and reassembled with inside and outside faces reversed, the shoe comprising:

(a) a generally flat, reversible sole;

(b) two side flaps, each affixed to the sole along a longitudinal side edge of the side flap, and a longitudinal side edge of the sole;

(c) a heel flap attached at one end to a posterior end of the sole;

(d) attachment means for attaching one portion of the shoe to another;

(e) a detachable heel; and (f) a heel plate attached to the sole, the heel plate having snap members on its face, the snap members being removably attachable to corresponding snap members on an upper face of the detachable heel;

wherein the attachment means are attached to the shoe along two opposite side edges of the heel flap on both faces, with complementary attachment means along a posterior end of each side flap on both faces; along both faces of a free edge of each side flap, with complementary attachment means on opposite anterior portions of the side flaps on both faces; and wherein the reversible shoe has a generally flat, unassembled position for storage, and two opposite assembled positions ready for wear as a shoe.

9. A reversible shoe comprising:

(a) a generally flat, reversible sole;

(b) two side flaps, each affixed to the sole along a longitudinal side edge of the side flap, and a longitudinal side edge of the sole;

(c) a heel flap attached at one end to a posterior end of the sole; and (d) attachment means for attaching one portion of the shoe to another;

wherein the attachment means are attached to the shoe along two opposite side edges of the heel flap on both faces, with complementary attachment means along a posterior end of each side flap on both faces; along both faces of a free edge of each side flap, with complementary attachment means on opposite anterior portions of the side flaps on both faces;

wherein the reversible shoe has a generally flat, unassembled position for storage, and two opposite assembled positions ready for wear as a shoe; and wherein the heel flap comprises from one to about five tabs projecting from each side edge of the heel flap, with the same number of tabs on each side edge, a means of attachment being affixed to both faces of each tab, with a corresponding means of attachment affixed to a posterior edge on both faces of each side flap, with the same number of attachment members on each side flap.

10. A reversible shoe according to claim 9, wherein the attachment means are buttons and buttonholes, or snaps.

11. A method for assembling a reversible shoe on a wearer's foot, the shoe comprising a sole, a tongue attached to an anterior end of the sole, two side flaps attached to the longitudinal edges of the sole, and attachment means attached to the shoe, the method comprising the steps of:

(a) pulling the heel flap up to a generally vertical position;

(b) attaching attachment means on the heel flap to complementary attachment means at the posterior ends of each of the side flaps;

(e) folding the tongue back over the top of the wearer's foot in the shoe;

(d) pulling the side flaps up over the wearer's foot;

(e) pulling a free edge of a rectangular flap, which is attached along one edge to a free edge of the side flap, over a top arch of the wearer's foot over to the opposite side flap;

(f) attaching attachment means on the free edge of the rectangular flap to corresponding attachment means on the opposite side flap; and (g) attaching the side flaps to one another at an anterior portion of the side flaps using corresponding attachment means on each side flap.

12. A method according to claim 11, wherein the attachment means comprise laces, and step (e) comprises removably fastening the side flaps to one another and the heel flap to the posterior edges of the side flaps by lacing at least one lace through eyelets along the edges of the side flaps and heel flap.

13. A method according to claim 11, further comprising the step of attaching a detachable heel to the bottom of the shoe at the heel.

14. A method according to claim 11, wherein the steps related to attaching the rectangular flap, (e) and (f), follow rather than precede the step related to attaching the side flaps to one another, (g).

15. A method according to claim 11, wherein the steps related to attaching the heel flap, (a) and (b), follow rather than preceded the step related to attaching the side flaps to one another, (g).

* * * * *